US005410994A

United States Patent [19]

Schechter

[11] Patent Number: 5,410,994

[45] Date of Patent: May 2, 1995

[54] FAST START HYDRAULIC SYSTEM FOR ELECTROHYDRAULIC VALVETRAIN

[75] Inventor: Michael M. Schechter, Farmington Hills, Mich.

[73] Assignee: Ford Motor Company, Dearborn, Mich.

[21] Appl. No.: 266,066

[22] Filed: Jun. 27, 1994

[51] Int. Cl.[6] ..... F01L 9/02

[52] U.S. Cl. ..... 123/90.12; 123/90.15

[58] Field of Search ..... 123/90.11, 90.12, 90.13, 123/90.15

[56] References Cited

U.S. PATENT DOCUMENTS

| | | | |
|---|---|---|---|
| 1,265,103 | 5/1918 | Nacker | 123/90.12 |
| 4,188,925 | 2/1980 | Jordan | 123/90.12 |
| 4,930,464 | 6/1990 | Letsche | 123/90.12 |
| 5,255,641 | 10/1993 | Schechter | 123/90.12 |
| 5,275,136 | 1/1994 | Schechter et al. | 123/90.12 |

FOREIGN PATENT DOCUMENTS

| | | |
|---|---|---|
| 880193 | 3/1943 | France . |
| 59-188016 | 10/1984 | Japan . |

*Primary Examiner*—Henry C. Yuen
*Assistant Examiner*—Weilun Lo
*Attorney, Agent, or Firm*—Jerome R. Drouillard; Roger L. May

[57] ABSTRACT

A hydraulic system for controlling an engine valvetrain wherein each of the reciprocating intake and/or exhaust valves is hydraulically controlled and selectively connected to a source of high pressure fluid and a source of low pressure fluid. The hydraulic system maintains fluid pressure both when the engine is running, by employing a pump and an auxiliary pump, and when engine is off, by employing an accumulator and by selectively employing an auxiliary pump controlled by an engine control system. By maintaining pressure in the hydraulic system, the engine valves begin operating immediately upon start-up of the engine even after it has been left idle for an extended period of time.

14 Claims, 1 Drawing Sheet

FAST START HYDRAULIC SYSTEM FOR ELECTROHYDRAULIC VALVETRAIN

FIELD OF THE INVENTION

The present invention relates to hydraulic systems in motor vehicle engines, and more particularly to systems for hydraulically controlling internal combustion engine intake and exhaust valves.

BACKGROUND OF THE INVENTION

The increased use and reliance on microprocessor control systems for automotive vehicles and increased confidence in hydraulic as opposed to mechanical systems is making substantial progress in engine systems design possible. One such electrohydraulic system is a control for engine intake and exhaust valves. The enhancement of engine performance to be attained by being able to vary the timing, duration, lift and other parameters of the intake and exhaust valves' motion in an engine is known in the art. This allows one to account for various engine operating conditions through independent control of the engine valves in order to optimize engine performance.

For proper starting of an internal combustion engine, suitable motion of the engine valves should begin as soon as the crankshaft begins its rotation. While electrohydraulic engine valve control systems in vehicles provide more flexibility to increase engine performance, they require a constant supply of pressurized hydraulic fluid to operate. Since the hydraulic engine valve control systems need to be operable when the engine is being started, even after the vehicle has been left idle for sometime, this requires a supply of pressurized fluid during engine start-up.

In a conventional camshaft driven valvetrain, proper motion of the engine valves is assured by mechanical connection between the crankshaft and the camshaft. In an engine with an electrohydraulic valvetrain, the mechanical link between the crankshaft and the engine valves is partially or completely absent and the proper motion of the engine valves can take place only when there is adequate hydraulic pressure in the system. If there is not adequate pressure in the hydraulic system, then proper engine valve motion cannot occur until the pressure is increased. Thus, a lack of pressure will delay engine start-up.

To assure fast start of an engine equipped with an electrohydraulic valvetrain, the system should remain filled with pressurized fluid even when the engine is not running. This pressure will prevent formation of fluid vapor bubbles and will cause the fluid to retain a relatively high value of the bulk modulus. Such a system, completely filled with hydraulic fluid, would require very little additional oil to increase its pressure. By maintaining system pressure, as soon as a hydraulic pump affixed to the hydraulic system begins to operate during engine start-up, there would be sufficient pressure to operate the engine valves, and within one or two pump revolutions the system could achieve its full operational pressure required for full engine operation. On the other hand, a hydraulic system that is not completely filled with pressurized fluid due to leakage during non-operating periods or due to contraction of the fluid from cooling off during non-operating periods, risks the formation of vapor bubbles and consequently cannot assure the immediate operation of the engine valves during engine start-up.

The need arises, then, in an engine with an electrohydraulically controlled valvetrain, to assure that there is hydraulic fluid pressure in the engine valve hydraulic system that allows immediate engine valve operation during start-up to ensure a fast start of the engine. This hydraulic system should maintain the pressure even if the engine has been idle for a period of time.

SUMMARY OF THE INVENTION

In its embodiments, the present invention contemplates an internal combustion engine having an operating state and a non-operating state. The engine comprises a cylinder head and an electrohydraulic valvetrain which includes a plurality of engine valve assemblies mounted in the cylinder head. The engine further comprises a hydraulic means, having fluid operatively engaging the plurality of engine valves, for supplying pressurized fluid to the engine valve assemblies, and a control means for selectively supplying fluid to move the engine valves in timed relation to the engine in the operating state. A pump means operatively engages the hydraulic means for pressurizing hydraulic fluid during the engine operating state. And, an auxiliary pump connects to the hydraulic means, for maintaining fluid pressure in the hydraulic means while the engine is in the non-operating state.

Accordingly, an object of the present invention is to provide a hydraulic system capable of supplying hydraulic fluid under pressure to operate engine valves while the engine is operating and to maintain enough pressure in the hydraulic system while the engine is idle that the engine valves can be operated immediately during the engine start-up process even after an engine has been in the non-operating state for a period of time.

An advantage of the present invention is fast start of an engine having an electrohydraulically controlled valvetrain, that does not require a time lag for hydraulic pressure to build up in the hydraulic system before it begins to operate the engine valves.

The present invention compensates for pressure losses associated with small leaks in the hydraulic system and contraction of the hydraulic fluid to assure the proper engine valve movement during engine start-up and prevents the formation of fluid vapor bubbles in the system.

DETAILED DESCRIPTION OF THE PREFERRED EMBODIMENTS

Figure 1:
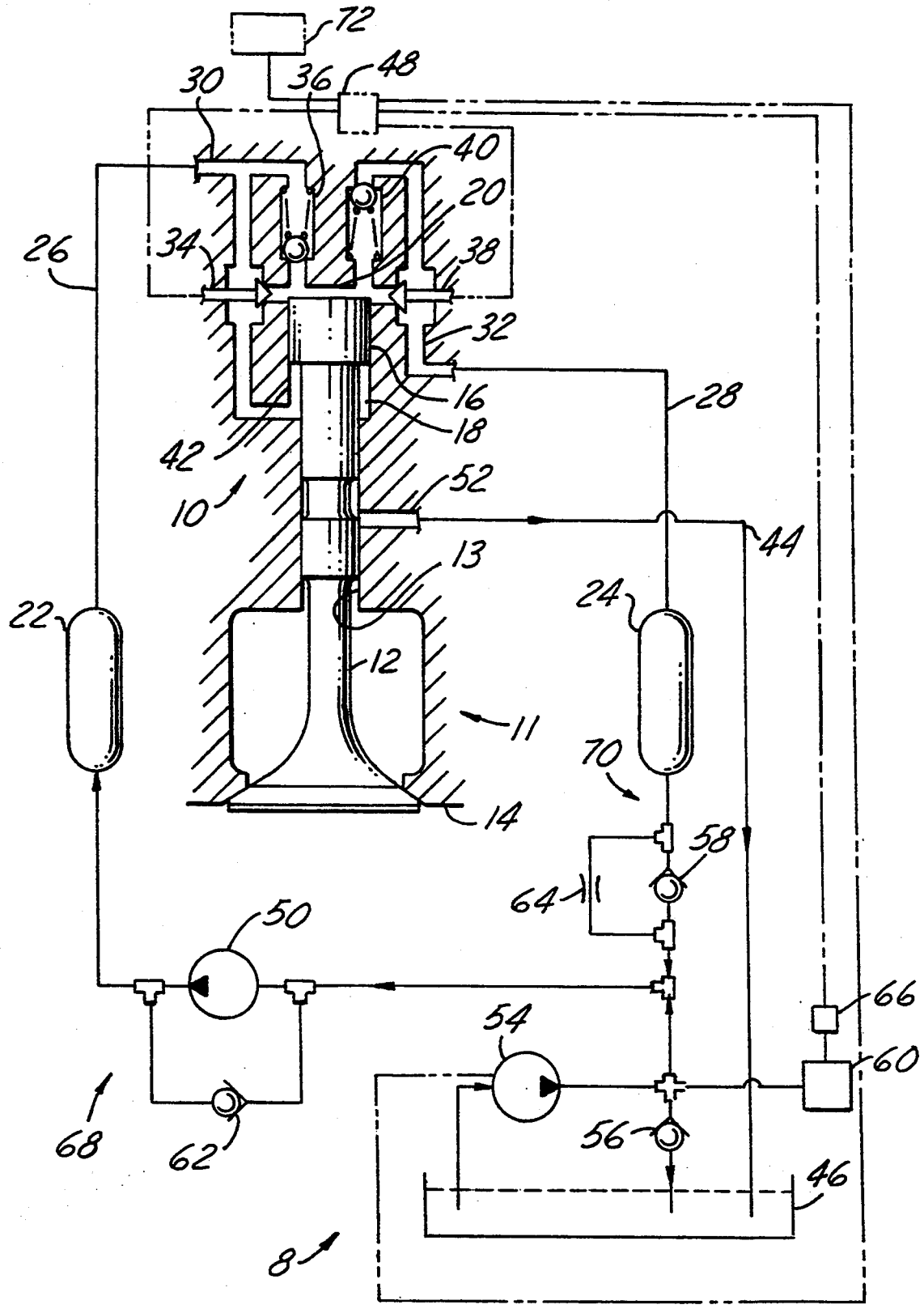
FIG. 1 is a schematic view of an electrohydraulic system connected to an electrohydraulically controlled engine valve.

FIG. 1 shows a hydraulic system 8, for controlling an entire valvetrain, connected to a single electrohydraulic engine valve assembly 10 of the electrohydraulic valvetrain. An electrohydraulic valvetrain is shown in detail in U.S. Pat. No. 5,255,641 to Schechter, which is incorporated herein by reference.

An engine valve 12, for inlet air or exhaust as the case may be, is located within a sleeve 13 in a cylinder head 14, which is a component of engine 11. A valve piston 16, fixed to the top of the engine valve 12, is slidable within the limits of piston chamber 18.

Hydraulic fluid is selectively supplied to volume 20 above piston 16 through a high pressure port 30 and a low pressure port 32. Volume 20 is connected to high pressure port 30 through a solenoid valve 34 or a check valve 36, or to low pressure port 32 through a solenoid valve 38 or a check valve 40. A volume 42 below piston 16 is always connected to high pressure port 30.

Engine valve opening is controlled by high-pressure solenoid valve 34 which, when opened, causes engine valve acceleration, and, when closed, causes deceleration. Opening and closing of low pressure solenoid valve 38 controls engine valve closing. An engine control system 48, which determines the opening and closing timing, is electrically connected to solenoid valves 34 and 38 and activates them to effect this timing.

During engine valve opening, high pressure solenoid valve 34 opens and the net pressure force acting on piston 16 accelerates engine valve 12 downward. When high pressure solenoid valve 34 closes, pressure above piston 16 drops, and piston 16 decelerates pushing the fluid from volume 42 below it back through high pressure port 30. Low pressure fluid flowing through low pressure check valve 40 prevents void formation in volume 20 above piston 16 during deceleration. When the downward motion of engine valve 12 stops, low pressure check valve 40 closes and engine valve 12 remains locked in its open position.

The process of valve closing is similar, in principle, to that of valve opening. Low pressure solenoid valve 38 opens, the pressure above piston 16 drops and the net pressure force acting on piston 16 accelerates engine valve 12 upward. When low pressure solenoid valve 38 closes, pressure above piston 16 rises, and piston 16 decelerates pushing the fluid from volume 20 above it through high-pressure check valve 36 back through high-pressure port 30 until valve 12 is closed.

In order to effectuate this valve opening and closing, a high pressure must be maintained in high pressure port 30, and a low pressure must be maintained in low pressure port 32. The preferred hydraulic fluid is oil, although other fluids can be used rather than oil.

High pressure port 30 connects to a high pressure fluid reservoir 22 through a high pressure line 26, forming a high pressure branch 68 of hydraulic system 8. An engine driven pump 50 supplies pressurized fluid to high pressure branch 68 and charges high pressure reservoir 22. Pump 50 is preferably of the variable displacement variety that automatically adjusts its output to maintain the required pressure in high pressure reservoir 22, and may be electrically driven rather than engine driven if so desired. Pump 50 is connected in parallel with a one-way check valve 62. Check valve 62 does not allow fluid to flow out of high pressure branch 68, but will allow fluid to flow in if the pressure in high pressure branch 68 drops below the pressure at the inlet to pump 50.

Low pressure port 32 connects to a low pressure fluid reservoir 24 through a low pressure line 28, forming a low pressure branch 70 of hydraulic system 8. A check valve 58 connects to low pressure reservoir 24 and is located to assure that pump 50 is not subjected to pressure fluctuations that occur in low pressure reservoir 24 during engine valve opening and closing. Check valve 58 does not allow fluid to flow into low pressure reservoir 24, and it only allows fluid to flow in the opposite direction when a predetermined amount of fluid pressure has been reached in low pressure reservoir 24. Check valve 58 is connected in parallel with an orifice 64, which only allows a very restricted flow of fluids through it. From low pressure reservoir 24, the fluid can return to pump 50, or sump 46.

The net flow of fluid from high pressure reservoir 22 through engine valve 12 into low pressure reservoir 24 largely determines the loss of hydraulic energy in system 8. A small additional loss is associated with leakage through the clearance between valve 12 and its sleeve 13. A fluid return line 44, connected to a leak-off passage 52, provides a route for returning any fluid which leaks out to a sump 46. This leakage fluid exits through leak-off passage 52 and returns to the sump 46 via return line 44.

An electrically driven auxiliary pump 54 is connected between sump 46 and the low and high pressure branches 68 and 70. Auxiliary pump 54 picks up fluid from sump 46 and delivers it to pump 50, assuring adequate inlet pressure in pump 50. Auxiliary pump 54 can be small since the quantity of fluid it delivers to pump 50 is small. The quantity of fluid supplied only needs to be enough to compensate for the leakage of hydraulic fluid through passage 52. Any excess fluid pumped by auxiliary pump 54 that is not needed by pump 50 returns to sump 46 through a pressure regulating valve 56. When the pressure at regulating valve 56 reaches a predetermined threshold, it opens, allowing fluid to flow back into sump 46. The pressure at regulating valve 56 determines the pressure at the inlet to pump 50. Auxiliary pump 54 is electrically connected to and controlled by engine control system 48. Generally, if engine 11 is running, then engine control system 48 causes auxiliary pump 54 to run continuously.

Hydraulic system 8 also includes an accumulator 60, which, during normal engine operations, becomes fully charged with fluid by auxiliary pump 54. The maximum magnitude of this pressure is governed by pressure regulating valve 56.

When engine 11 stops running, the fluid in hydraulic system 8 cools off, causing it to contract. This causes the pressure of the fluid in system 8 to drop. Further, there is always a small amount of leakage. As the pressure in system 8 drops, accumulator 60 discharges fluid into system 8, thus compensating for the contraction and leakage to prevent formation of pockets of vapor.

As the pressure drops in high pressure fluid reservoir 22 to below that in accumulator 60, it is fed fluid from accumulator 60 through one-way check valve 62. As the pressure in low pressure reservoir 24 drops below that of accumulator 60, it is slowly fed fluid through orifice 64. Orifice 64 is sized to be small enough to prevent pressure waves propagation through it during each engine cycle while engine valve assembly 10 is operating, but sufficiently large to permit slow flow of fluid from accumulator 60 into low pressure reservoir 24 while engine 11 is idle. If so desired, orifice 64 can be incorporated directly into check valve 58.

Accumulator 60, then, maintains both the high and low pressure branches 68 and 70 of hydraulic system 8 above atmospheric pressure when engine 11 is not running by this continuous process of replenishing the fluid as it contracts or leaks out. When engine 11 is restarted, accumulator 60 is recharged again by auxiliary pump 54.

If engine 11 is not restarted for a long period of time, as is the case for example when a vehicle is left in long term parking, accumulator 60 may eventually become discharged. A pressure sensor 66 is connected to accumulator 60 and electrically connected to engine control system 48. Pressure sensor 66 monitors the pressure in accumulator 60, and when the pressure drops to an unacceptable level sends a signal to engine control system 48.

Engine control system 48 reactivates auxiliary pump 54 for a short period of time sufficient to recharge accumulator 60. The period of time that auxiliary pump 54 runs can be determined in either one of two ways. First it can be run for a fixed amount of time each time it is employed, or it can be run until pressure sensor 66 senses that the fluid pressure is at a predetermined acceptable value at which point auxiliary pump 54 will be shut off. This recharge process can be repeated many times, thus maintaining hydraulic system 8 under a low level of pressure until engine 11 is restarted again.

Auxiliary pump 54 is small and so the power consumption of it is very low. Nevertheless, if engine 11 is not restarted for an indefinitely long period of time, repeated operation of pump 54 can drain vehicle battery 72. To avoid this, engine control system 48 employs logic that discontinues the process of recharging accumulator 60 if the battery voltage becomes too low. Each time the fluid pressure in accumulator 60 drops below the minimum value, engine control unit 48 first checks the battery voltage. If the battery voltage is not below a predetermined value, then control system 48 sends a signal to activate auxiliary pump 54 in order to charge up accumulator 60; if it is, then pump 54 will not be activated.

An alternate way to prevent too much drainage of battery 72 is to discontinue the process of periodic reactivation of auxiliary pump 54 after a specific period of time has elapsed, for example one month.

While certain embodiments of the present invention have been described in detail, those familiar with the art to which this invention relates will recognize various alternative designs and embodiments for practicing the invention as defined by the following claims.

I claim:

1. An internal combustion engine having an operating state and a non-operating state comprising:

a cylinder head;

an electrohydraulic valvetrain including a plurality of engine valve assemblies mounted in the cylinder head;

hydraulic means, having fluid operatively engaging the plurality of engine valves, for supplying pressurized fluid to the engine valve assemblies;

a control means for selectively supplying fluid to move the engine valves in timed relation to the engine in the operating state;

pump means, operatively engaging the hydraulic means, for pressurizing hydraulic fluid during the engine operating state; and an auxiliary pump, connected to the hydraulic means, for maintaining fluid pressure in the hydraulic means while the engine is in the non-operating state.

2. An engine according to claim 1 wherein the control means further comprises an engine controller and a plurality of solenoid valves electrically connected thereto, with the solenoid valves operatively engaging the hydraulic means.

3. An engine according to claim 2 further comprising a pressure sensor connected to the hydraulic means and electrically connected to the engine control means such that the engine control means will activate the auxiliary pump when a signal is received from the pressure sensor while the engine is in the non-operating state.

4. An engine according to claim 3 wherein the engine further includes a battery and wherein the engine control means ceases operation of the auxiliary pump if voltage in the battery is below a predetermined value while the engine is in a non-operating state.

5. An engine according to claim 3 wherein the engine control means ceases operation of the auxiliary pump after a predetermined period of time has elapsed with the engine continuously in the non-operating state.

6. An engine according to claim 1 further comprising a hydraulic accumulator operatively engaging the hydraulic means and the auxiliary pump for storage and release of pressurized fluid such that the auxiliary pump periodically charges the accumulator during the engine non-operating state.

7. An engine according to claim 1 wherein the hydraulic means includes a high pressure branch and a low pressure branch operatively engaging one another and also operatively engaging the engine valve assemblies.

8. An engine according to claim 7 wherein the pump means comprises a high pressure pump for pumping fluid into the high pressure branch and a check valve connected in parallel with the high pressure pump, with the check valve selectively allowing fluid to flow in the direction of the high pressure branch but preventing flow in the opposite direction.

9. An engine according to claim 8 further comprising a check valve mounted between the high pressure pump and the low pressure branch to protect the high pressure pump from any pressure fluctuations that may occur in the low pressure branch while the engine is in the operating state.

10. An engine according to claim 9 further comprising a hydraulic accumulator operatively engaging the high and the low pressure branches and the auxiliary pump for storage and release of pressurized fluid.

11. An engine according to claim 10 further comprising a pressure regulating means operatively engaging the hydraulic means and the auxiliary pump, for limiting the pressure of fluid that the auxiliary pump can deliver to the high and the low pressure branches, with the auxiliary pump operating continuously while the engine is in the operating state.

12. An engine according to claim 11 further including an orifice operatively engaging the hydraulic pressure means such that fluid can flow into the low pressure branch.

13. An engine according to claim 1 wherein the cylinder head includes an enclosed bore and chamber coupled to a high pressure port and a low pressure port for each engine valve assembly; and wherein each engine valve assembly comprises an engine valve shiftable between a first and a second position within the enclosed bore and chamber; a valve piston coupled to the engine valve and reciprocable within the enclosed chamber which thereby forms a first and a second cavity which vary in displacement as the engine valve moves; the high pressure port extending between the first and second cavities and the hydraulic means and the low pressure port extending between the first cavity and the hydraulic means; a high pressure valve and a low pressure valve for respectively regulating the flow of fluid in the first cavity; and wherein the engine control means cooperates with the high and low pressure valves for selectively coupling the first cavity to the hydraulic means to oscillate the engine valve in timed relation to engine operation in the engine operating state.

14. An electrohydraulic system for controlling the operation of engine valves with hydraulic fluid in an internal combustion engine comprising:

a high pressure branch operatively engaging the engine valves and containing fluid therein;

a low pressure branch operatively engaging the engine valves and containing fluid therein, with the low pressure branch connected to the high pressure branch;

a high pressure pump connected to the high pressure branch for pressurizing the hydraulic fluid in the high pressure branch;

a check valve connected in parallel with the high pressure pump;

a pressure regulating system coupled to the high and low pressure branches for maintaining pressure therein, with the pressure regulating system including an auxiliary pump and a hydraulic accumulator connected to the high and low pressure branches, and a pressure sensor operatively engaging the hydraulic accumulator;

an engine control means, electrically connected to the auxiliary pump and the pressure sensor, for sensing the fluid pressure in the accumulator and controlling the operation of the auxiliary pump;

an orifice connected between the high and the low pressure branches such that fluid can flow into the low pressure branch; and a check valve connected between the high and the low pressure branches and in parallel with the orifice.

* * * * *